United States Patent [19]

Sciotti

[11] 4,165,574

[45] Aug. 28, 1979

[54] PATENTEE'S FINGER RING OR EMBLEM

[76] Inventor: Robert Sciotti, 31821 Wellston, Warren, Mich. 48093

[21] Appl. No.: 136,792

[22] Filed: Apr. 23, 1971

[51] Int. Cl.[2] ..... G09F 3/14

[52] U.S. Cl. ..... 40/21 R; 40/618; 63/29 R

[58] Field of Search ..... 40/1, 21, 21 C, 140, 40/618; 63/29 R

[56] References Cited

U.S. PATENT DOCUMENTS

| | | | |
|---|---|---|---|
| D. 4,919 | 5/1871 | Denney | 40/1.5 X |
| D. 66,702 | 2/1925 | Pursley | D29/2 R |
| 1,442,738 | 1/1923 | Seeler | 63/15.6 |
| 1,460,111 | 6/1923 | Panikff | 40/1.5 |
| 1,504,413 | 8/1924 | Atwell | 40/1 |
| 2,134,586 | 10/1938 | Silver | 63/15 |
| 2,216,305 | 10/1940 | Weed | 40/21 A |
| 2,253,343 | 8/1941 | Nalick | 63/29 R X |
| 2,517,009 | 8/1950 | McDermott | 40/1.6 |
| 2,653,402 | 9/1953 | Bonagura | 40/21 A |
| 3,214,939 | 11/1965 | Monahan | 63/15.6 |
| 3,545,380 | 12/1970 | Comegys | 40/2.2 |
| 3,599,359 | 8/1971 | Michael | 40/10 |
| 3,599,359 | 8/1971 | Michael | 40/10 |

FOREIGN PATENT DOCUMENTS

| | | | |
|---|---|---|---|
| 915360 | 11/1946 | France | 40/1.5 |

*Primary Examiner*—Louis G. Mancene
*Assistant Examiner*—Wenceslao J. Contreras

[57] ABSTRACT

A universal patentee's ring, pin, emblem or similar device comprises the combination of a body having means for attachment thereof to a finger, article of clothing or the like, indicia formed on or attached to the body indicating that the wearer or owner is an inventor-patentee, and a legend formed on or carried by the body specifying additional information concerning the indicia and/or comprising additional adornment for the device, the legend in one form of the invention being carried by an interchangeable element enabling the legend to be changed when the wearer's or owner's inventor-patentee status changes, an element for the finger ring embodiment of the invention being available in varying dimension so as to adapt the ring to the size of the finger.

4 Claims, 12 Drawing Figures

PATENTEE'S FINGER RING OR EMBLEM

BRIEF SUMMARY OF THE INVENTION

This invention relates to finger rings, pins, emblems for personal items such as cuff links and tie clips and other items of jewelry and the like, and more particularly to a patentee's finger ring, pin or emblem, including, in addition to structural features specifically relating to recognition of patentees, additional structural features applicable to any items of this general type.

Under authority contained in the Constitution, the Congress of the United States enacted the first patent laws going on two hundred years ago, in 1790, and, as a result of the process of diligent examination by the Patent Office examining corps and response by the applicants, in excess of three and one-half million patents have been granted to date, to both private and corporate employe inventors.

Whatever view one might have as to how the patent laws might be improved, there is little doubt that the United States patent system has created vast industry and wealth and contributed substantially to the world's highest standard of living. Countless numbers of our outstanding citizens, from President Washington to present-day figures, have made sincere, often-quoted laudatory statements about the patent system, patents and inventors.

There seems to be no end in sight. For example, whenever a problem arises, such as the current problem of water and air pollution control, at least hundreds of inventors, both corporate and private, set out to seek the personal and monetary rewards of patentable solutions. There is usually little doubt that solutions will be found, and in a relatively short time, as has occurred many times in the past, during both peace and war. In fact, to expedite this process, President Nixon has directed that such patent applications can be placed on a SPECIAL status at the request of the applicant.

Further, patent systems exist in most nations of the world, and each such country issues an admittedly impressive original patent document. Also, various degrees of monetary rewards to inventors are provided in the various countries, and by various employers within any given country. In connection with the latter, a pin or finger ring according to the invention, along with a monetary award, would be appreciated by an employe patentee. Further, there is a National Inventors Council, many technical societies and at least one society that annually honors a particular selected outstanding inventor.

However, in all this time, except for the original patent document which a patentee normally does not carry with him but keeps with his records, and which a corporate-employe patentee-inventor rarely ever sees, no easily recognizable way or means has been provided to identify the ordinary inventor-patentee, in whose name at least one patent has been issued and on whom the successful operation of our patent system depends, partly because they far outnumber the prolific or famous patentees.

Accordingly, a main object of this invention is to provide such long-needed means for private and corporate-employe inventor-patentees to recognize one another in public, and to be recognized by the public.

Another object of the invention is to provide such means in the form of a ring, pin, cuff links, tie clip and other items of jewelry or emblems by which inventor patentees may be recognized.

A still further object of the invention is to provide such means comprising the combination of a body having means for attachment thereof to a finger or other support, indicia means easily recognizable by the non-patentee public and to indicate that the wearer or owner is an inventor or an inventor-patentee and legend means to indicate further specific information regarding the inventor's patent status, such as the fact that he is a patentee and the number of patents issued to the patentee and/or the issuing country.

Another object of the invention is to provide such means wherein at least the legend means is actually or in part formed to cooperate with said body means so as to be readily interchangeable to provide different specific legend information when the inventor-patentee's circumstances change, as when additional patents issue to him.

Still another object of the invention is to provide a finger ring having interchangeable means, whereby a particular dimension thereof may be varied so as to adapt a particular finger ring size to better fit a finger size falling between available ring sizes.

Another object of the invention is to provide a ring or other similar article of jewelry and the like wherein a readily removable element may be employed to removably retain therein an ornamental element such as a birthstone or the like.

These and other objects and advantages of the invention will become more apparent by reference to the detailed description below and the attached drawings.

Figures 1, 2, 3, 4, 5, 6, 6A, 6B, 7, 8, 9, 10:
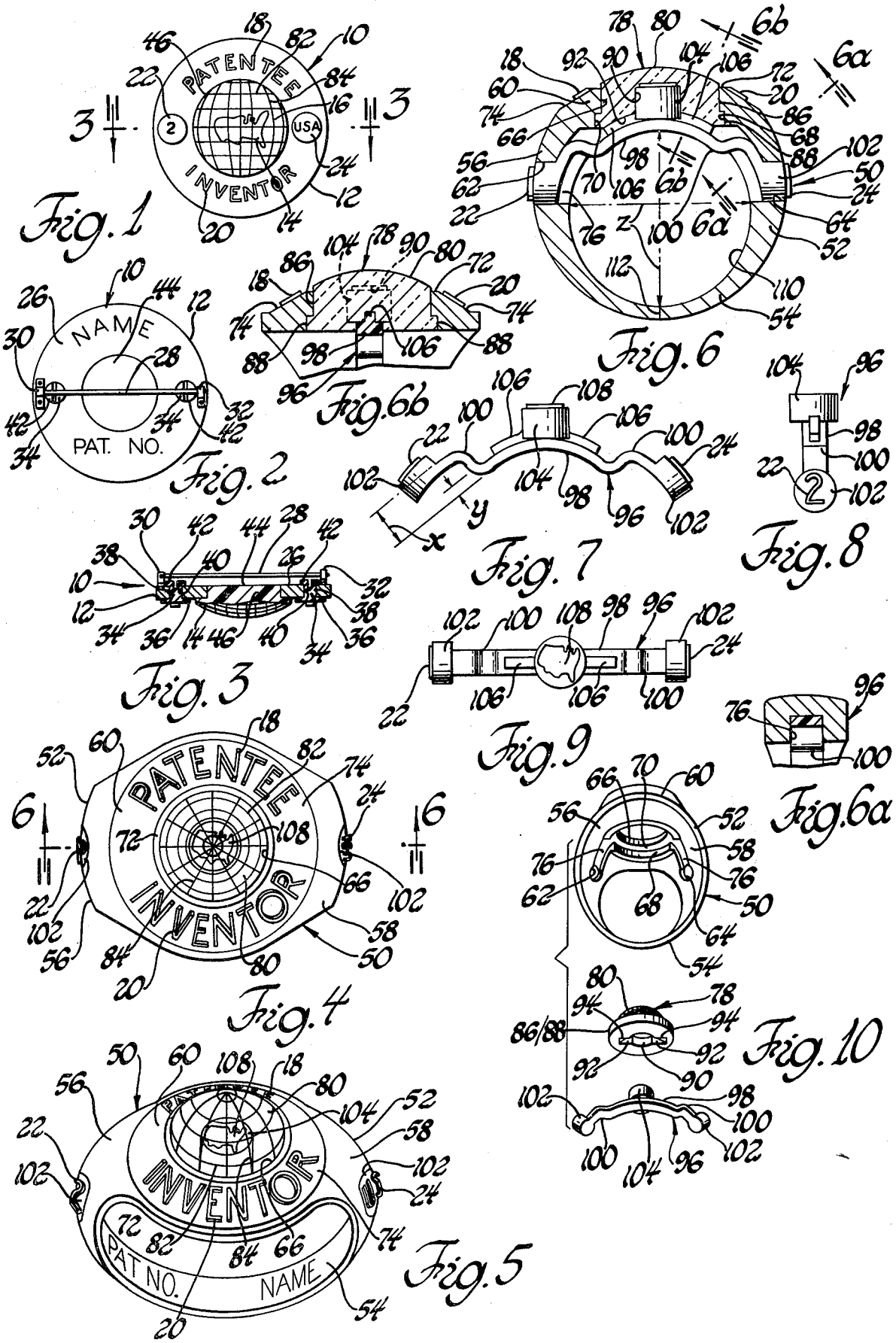
FIG. 1 is a front plan view of a pin or emblem embodying the invention.
FIG. 2 is a rear plan view of a pin embodying the invention.
FIG. 3 is a cross-sectional view, taken on the plane of line 3—3 of FIG. 1, and looking in the direction of the arrows.
FIG. 4 is a top view of a finger ring embodying the invention.
FIG. 5 is a perspective view of the ring shown in FIG. 4.
FIG. 6 is a cross-sectional view taken on the plane of line 6—6 of FIG. 4, looking in the direction of the arrows.

FIGS. **6*a* and 6*b* are cross-sectional views taken on the planes of lines a—a and b—b of FIG. 6**, looking in the direction of the arrows.

FIG. 7 is a side elevational view of an element of FIG. 6, the element being shown in its free, unassembled condition.

FIG. 8 is an end elevational view of the element shown in FIG. 7.

FIG. 9 is a top plan view of the element shown in FIG. 7.

FIG. 10 is an exploded perspective view of the elements of the finger ring assembly shown in cross-section in FIG. 6.

DETAILED DESCRIPTION

Referring now to the drawings in greater detail, and particularly to FIGS. 1–3, there is illustrated, in FIG. 1, a front view of a pin or emblem 10 embodying the invention. The body 12 may be of any desired size or shape, and constructed from any desired material. For example, if 10 were a pin, the body might be constructed from an appropriate jewelry-type metal, such as silver or gold. In the case of use as an emblem, it could be imprinted on playing cards, stationery or the like, or it might be a cloth patch to be sewn on a jacket, or other article of wearing apparel.

The main structural feature of the emblem 10 is that is includes any desired center ornamental design, such as the outline of the country 14 on a globe 16, such as the United States, issuing the patent, the emblem having printed or otherwise formed around the center design thereof the indicia "patentee" 18 and "inventor" 20.

However, the indicia "patentee" and "inventor" do not give the complete information about the patentee-inventor's status. To supplement the indicia, the invention also provides a legend 22, which indicates the number of patents issued to the patentee and a legend 24 indicating the name, or the abbreviation of the name, of the issuing country.

Of course, since patents are issued by most of the countries of the world, the indicia 18/20 and the legend 22/24 can obviously be foreign equivalents, and in the foreign language.

FIG. 2 merely illustrates the backside 26 of a pin, showing the pin 28 hinged at 30 and clasped or locked at 32 in the usual, well-known manner.

FIG. 3 is a cross-sectional view taken on line 3—3 of FIG. 1, particularly where 10 is a pin, illustrating the structural feature of replaceable legends 22/24 and a replaceable central design. Legend elements 34 can be constructed from metal or from one of the attractive, highly-polished plastic materials available today, each having a head 36 with the legend thereon engaging the front of the body and an integral stem 38 passing through opening 40 formed in the body, the ends of the stem having compressible and expanding abutments 42 to engage the rear surface 44 of the pin.

Replaceable legend elements 34 are desirable, especially the element having the number legend 22 thereon, so that the number can be changed as additional patents issue to the patentee. Of course, the central design 14/16 can be constructed as a replaceable snap-in or pressed-in element 46, like the legend elements 34.

It is thus seen that the pin or emblem 10 comprises the combination of a body 12, a central design 46 of any suitable configuration, such as a globe 16 portion including the outline 14 of the issuing country, an indicia, such as "patentee" 18 and/or "inventor" 20 indicating that the owner or wearer of the emblem, pin or other similar item is a patentee and a legend 22/24 indicating further the number of patents issued to the patentee and, if desired, the abbreviation of the issuing country.

That is, for maximum and complete identification of the wearer of the pin, for example, the entire combination of body 12, indicia 18/20 and legend 22/24 are required or desirable. The body 12 carries the indicia 18/20 and the legend 22/24, the indicia to provide identification or recognition of a patentee-inventor and the legend to indicate the inventor-patentee's degree of patentable creativity and nationality.

Since most patentees are men, for whatever reason, a more common item of men's jewelry of the type providing recognition or identification is the finger ring.

As shown by FIGS. 4–6 and 10, a finger ring 50 embodying the invention comprises a ring body 52, preferably of a massive type configuration, including a band portion 54, side portions 56 and 58 and a top portion 60.

As will be seen, the "patentee" and "inventor" indicia 18/20 are disposed on the top portion 60, while the legend 22/24 is disposed on the side portions, the inner side of the band portion 54 being available for engraving of the owner's name and one or more patent numbers, if desired.

As explained in Whitaker U.S. Pat. No. 2,140,396, a well-known method of manufacturing finger rings is to stamp or roll the same, to form a complete body. Since such a method may be employed to form a finger ring 50 embodying the invention, keeping this in mind will facilitate a better understanding and appreciation of the invention.

Referring to FIGS. 6 and 10, it will be noted that the side portions 56 and 58 are formed with openings 62 and 64, respectively, extending therethrough. While the openings 62 and 64 are shown as being round, they may be of any desired shape. The top portion 60 is likewise formed therethrough with an opening 66, the opening preferably being round for a reason to be explained, although it too could be of any desired shape. The opening 66 is formed with an undercut portion 68 forming a stop 70.

The top portion 60 surrounding the opening 66 may be formed with a flat portion 62 and a surrounding beveled portion 74, upon which the "patentee" and "inventor" indicia 18/20 are formed, preferably, as explained above, by stamping or rolling dies. It will be noted that the "patentee-inventor" indicia is disposed so that it can be read from the same side of the ring, as opposed to the usual practice of lettering around a center design or setting so that, from any one side, part of the lettering is sideways and upside down.

The inner surfaces of the side portions 56 and 58 and top portion 60 are formed with opposite grooves 76 extending between each of the side openings 62 and 64 and the top opening 66 and of suitable depth and width, for a purpose to be described.

As seen in FIGS. 4–6, **6*a*, 6*b* and 10, a second element 78 of the finger ring may comprise a transparent clear or colored plastic, glass or semi-precious or precious stone. While the ornamental element 78 may be of any desired configuration, for the purposes of the particular embodiment of the invention shown herein, for purposes of illustration, the element is circular, with a convex top surface 80 formed as a portion of a globe, preferably with latitude and longitude lines 82 and 84 formed thereon. Adjacent the globe portion 80 are cylindrical portions 86 and 88 adapted to be received in the top opening 66, the flange or larger diameter cylindrical portion 88 being received in the undercut 68 so that element 78 can be inserted into and removed from the opening 66 from the inner side of said top portion 60, but cannot be removed from the outer side of said top portion. The periphery of the globe portion may terminate at or join the smaller diameter cylindrical portion 86 at the flat upper surface 72 of the top portion 60 when assembled as shown in FIG. 6**.

The underside or the side of the ornamental element 78 opposite the globe, as seen in FIGS. 6 and 10, is formed with a cylindrical cavity 90 having extending from the opposite sides thereof grooves 92 having parallel sides and arcuate bases 94, the grooves in the element 78 being adapted to be aligned, on assembly, with the grooves 76 formed in the ring body, all for a purpose to be described.

A third element of ring 50 is a resilient insert member 96, which is preferably formed, as by injection molding, from a resilient material that can be colored, plated or otherwise treated so as to be capable of presenting a high polished metallic or other attractive ornamental appearance suitable for or compatible with the manufacture of items of jewelry and the like.

In the form illustrated, member 96 has a free position as shown in FIGS. 7–10 and comprises a bow-like structure having a curved center section 98 and return-bend end sections 100, each end section having a cylindrical legend bearing member 102. A cylindrical legend member 104 is formed on or secured to the middle of the center section 98, and ribs 106 extend from the cylindrical member. It will be noted that one of the legend members 102 may have a number, legend 22, formed thereon, while the other legend member 102 may have a legend 24, the abbreviation of the name of a country formed thereon. The cylindrical member on the center section may have an outline 108 of the patent issuing country formed therein. These legends 18/20, as well as the legend outline 108, may be raised from or otherwise suitably formed on the surfaces on which they are formed.

Ribs 106, as seen in FIGS. 6 and **6*b*, are received in the grooves 92 in the element 96**, thereby preventing rotation thereof when assembled.

Another important general feature of the invention (see FIG. 7) is that the member 96 is formed so that either the dimension "X" and/or the thickness "Y" thereof can be varied. Thus, as shown in FIGS. 6, **6*a* and 6*b*, the inner surface of center portion 98 can be made to lie within the circumference of circular opening 110** (diameter "Z") through which the finger is inserted when putting on the ring, for a purpose to be described.

MANUFACTURE AND ASSEMBLY

As previously explained, each ring assembly is capable of manufacture by means such as stamping, whereby the general body shape, all of the "patentee-inventor" indicia, openings and grooves are simultaneously formed. The sides and band portions are then formed into generally circular shape and the band soldered or otherwise joined, as at 112.

In the prior art, finger rings are made in a series of standard sizes, and, the proper size is selected. If a proper fit is not found, a slightly-too-small ring may be selected and expanded to provide a more exact fit.

The ring embodying the invention also can be manufactured in a series of standard sizes. However, the invention provides a novel method of final fitting, this feature being applicable to any ring constructed to incorporate the same.

Returning now to the matter of recognition of patentee-inventors, it should be said that every patentee must necessarily have been an inventor. However, the converse is not true; that is, many inventors are not patentees, as evidenced by patent applications that are finally rejected as unpatentable over prior art and allowed to become abandoned. However, once an inventor has been issued a patent, he is a patentee-inventor, for life. In this connection, it can be stated that the indicia could be considered as the designation "inventor" 18, in which case the legend could be considered as including the designation "patentee" 20, as well as the legend portions 22 and 24.

Thus, for patentee-inventors of English language countries, for example, a ring manufacturer, in a single run, can make a stock of finger ring bodies 52 formed exactly alike, but in a range of sizes (diameter "Z") and/or colors, such as gold and silver. Similarly, a stock of elements 78 can be formed all at one time, in a series of colors or designs, for example. Also, a stock of members 96 may be made, in various series of "X" and "Y" dimensions, legends 22 and 24, color or design and/or country outline 108.

Consider now, for example, a United States inventor that holds two patents, has a birthdate signified by a blue stone and has a ring finger such that a size nine ring is too tight but a size ten ring is too loose. If he were to purchase a ring embodying the invention, the jeweler could select a size ten ring body 52 of the desired color, a blue element 78 and a member 96 of the desired color having a United States outline 108, a "U.S.A." legend 24, a "2" legend 22 and dimensions "X" and/or "Y" such that the ring, when assembled, fits properly.

The jeweler would then very easily and quickly assemble a complete ring 50 meeting the patentee-inventor's requirements by first inserting the selected element 78 into the opening 110 and up through the opening 66 until the portion 88 is received in the undercut 68 and the grooves 92 are aligned with the grooves 76 formed in the ring body 52. The final step in assembly would be to insert the selected member 96 into the opening 110 and the legend member 102 having the legend 22 (or the member 102 having the legend 24) into the opening 62 (or 64), compress the member 96 and insert the member 104 having the United States outline into the cavity 90 and the ribs 106 into the grooves 92 and then allow the resiliency of member 96 snap the member 102 having the legend 24 (or 22) into the opening 64 (or 62). The resiliency of member 96 maintains it and the element 78 firmly in place to prevent inadvertent removal.

Assuming now that the patentee-inventor has additional patents issued in his name, he can very easily and inexpensively update the legend by simply purchasing another member 76 having a legend 22 that indicates the new total number of patents issued to him. In fact, the member 96 can be so inexpensive that the purchase price of the ring can include unlimited updating of the legend, as a special marketing feature.

Obviously, for patentee-inventors issued patents by countries other than English language countries, the indicia "patentee" and/or "inventor", or their equivalent, can be in the particular foreign language involved, and the outline 108 and legend 24 for the particular country can be employed.

What has been described above for the ring 50 is generally applicable to the pin or emblem 10, the latter being generally applicable to items such as belt buckles, tie pins, cuff links, medallions attachable to brief cases, letterheads and the like.

SUMMARY

In addition to other objects and advantages, it will be apparent that the invention provides a means by which patentee-inventors may be recognized, and more particularly a combination of a body, indicia and a legend, in a ring or other item of jewelry or emblem, by which the current patentee status of a patentee-inventor can be immediately recognized.

Considered more broadly in another aspect, the invention provides a ring, pin or the like formed so that suitable, universal and permanent indicia are combined with an easily-replaceable, inexpensive legend to be updated when desired. This might be desirable in the case of a ring or pin designating fraternal organizations, various associations, corporate years of service and the like.

In another aspect, the invention provides a composite pin, ring or the like wherein the various ornamentation thereof, such as the center ornament, may be readily changed for whatever reason, and yet held securely assembled until such time as disassembly is desired.

The general construction disclosed herein may also be employed for inexpensive novelty rings made from cheaper materials, such as plastics or inexpensive metals, and having therefor, or as a part thereof, a variety of interchangeable center ornaments for special occasions.

In still another aspect, the invention provides a novel means of fitting a ring or changing the ring size, for example when a ring is passed on to heirs.

Thus, while the invention has been disclosed, for purposes of illustration, in such clear and concise terms as to enable anyone skilled in the art to practice the same, in the form of an emblem, pin or ring, each of a particular design, no limitations are intended except as recited in the appended claims.

What I claim as my invention is:

1. A finger ring, comprising a body having joined band, side and top portions forming an inner ring surface, said top portion being formed with a center design or ornamentation and having indicia thereon around said design or ornamentation representing any desired status of the wearer and at least one of said side portions having a legend member thereon providing more specific additional information regarding said status indicia, said legend member being formed so as to be removably secured to said body by means cooperating with said inner surface and being free of separate fasteners so as to be replaceable when the wearer's additional information status changes, thereby bringing said legend information up-to-date, said top portion being formed with a central opening having a larger dimension at the inner surface of said top portion and a smaller dimension at the outer surface of said top portion, said center design or ornamentation comprising an element being formed so as to be receivable in said top opening and having dimensions such that is insertable through said top opening from the inner circumference of said ring but cannot be removed from said opening from the outer diameter of said ring, each of said side portions having an opening at least at the inner surface thereof and a slot connecting said side opening with said top opening, said element being formed with a slot aligned with said side slots, said legend comprising a resilient member compressed lengthwise and having end portions received in said side openings and intermediate portions received in said slots, whereby the tendency of said resilient member to return to its free state retains said member removably secured to said body and said element removably secured to said body in proper orientation with respect thereto, said side openings extending through said sides and said ends of said resilient members receivable in said side openings having said legend formed thereon so as to be visible at the outside of said ring, said element being transparent, said intermediate portion of said member having ornamentation thereon visible through said element.

2. A finger ring such as that recited in claim 1, wherein said element is formed as a portion of a globe with latitude and longitude lines thereon and said ornamentation visible therethrough is the outline of a land portion of the earth's surface.

3. A finger ring comprising a body having joined band, side and top portions forming an inner ring surface, said top portion having indicia thereon representing any desired status of the wearer and at least one of said side portions having a legend member thereon providing additional information regarding said status indicia, said legend member being formed so as to be removably secured to said body by means cooperating with said inner surface and being free of separate fasteners so as to be replaceable when the wearer's additional information status changes, thereby bringing said legend information up-to-date, said side portions being formed, at the inner surface thereof, with grooves and said legend being formed on a resilient member having portions adapted to be received in said grooves and a free state configuration such that it may be compressed endwise for insertion of said member portions into said grooves for retention on said body by the tendency of said member to return to its free state.

4. A finger ring comprising a body having joined band, side and top portions forming an inner ring surface, said top portion having indicia thereon representing any desired status of the wearer and at least one of said side portions having a legend member thereon providing additional information regarding said status indicia, said legend member being formed so as to be removably secured to said body by means cooperating with said inner surface and being free of separate fasteners so as to be replaceable when the wearer's additional information status changes, thereby bringing said legend information up-to-date, said top portion being formed with a center design or ornamentation, said indicia being formed around said design or ornamentation, said top portion being formed with a central opening having a larger dimension at the inner surface thereof and a smaller dimension at the outer surface thereof, said center design or ornamentation comprising an element being formed so as to be receivable in said top opening and having dimensions such that it is insertable through said top opening from said inner circumference of said ring but cannot be removed from said opening from the outer diameter of said ring, each of said side portions having an opening at least at the inner surface thereof and a slot connecting said side opening with said top opening, said element being formed with a slot aligned with said side slots, said legend comprising a resilient member compressed lengthwise and having end portions received in said side openings and intermediate portions received in said slots, whereby the tendency of said resilient member to return to its free state retains said member removably secured to said body and said element removably secured to said body in proper orientation with respect thereto.

* * * * *